US007694714B2

(12) United States Patent
Manda

(10) Patent No.: US 7,694,714 B2
(45) Date of Patent: Apr. 13, 2010

(54) METAL MOLDING

(75) Inventor: Jan Marius Manda, Toronto (CA)

(73) Assignee: Husky Injection Molding Systems Ltd., Bolton, ON (CA)

( * ) Notice: Subject to any disclaimer, the term of this patent is extended or adjusted under 35 U.S.C. 154(b) by 0 days.

(21) Appl. No.: 11/349,984

(22) Filed: Feb. 9, 2006

(65) Prior Publication Data

US 2007/0181281 A1 Aug. 9, 2007

Related U.S. Application Data

(63) Continuation of application No. 11/297,926, filed on Dec. 9, 2005, now abandoned, which is a continuation of application No. 11/347,302, filed on Feb. 6, 2006.

(51) Int. Cl.
*B22D 17/00* (2006.01)

(52) U.S. Cl. ..... 164/312; 164/113; 164/900

(58) Field of Classification Search ..... 164/312, 164/113, 900
See application file for complete search history.

(56) References Cited

U.S. PATENT DOCUMENTS

| | | | | |
|---|---|---|---|---|
| 5,040,589 | A | 8/1991 | Bradley et al. | |
| 6,059,012 | A * | 5/2000 | Vining et al. | 164/312 |
| 6,065,526 | A * | 5/2000 | Kono | 164/113 |
| 6,533,021 | B1 | 3/2003 | Shibata et al. | |
| 6,938,669 | B2 | 9/2005 | Suzuki et al. | |
| 2005/0006046 | A1 | 1/2005 | Tanaka et al. | |
| 2006/0000572 | A1 * | 1/2006 | Tanaka et al. | 164/79 |
| 2006/0196626 | A1 * | 9/2006 | Decker et al. | 164/312 |

FOREIGN PATENT DOCUMENTS

| | | |
|---|---|---|
| JP | 1021916 | 8/1998 |
| WO | WO 99/28065 A1 | 6/1999 |
| WO | WO 03/106075 A1 | 12/2003 |

OTHER PUBLICATIONS

A.I. "Ed" Nussbaum, Semi-Solid Forming of Aluminum and Magnesium, Light Metal Age, Jun. 1996, 10 pages.

* cited by examiner

*Primary Examiner*—Kevin P Kerns
(74) *Attorney, Agent, or Firm*—Husky Intellectual Property Services

(57) ABSTRACT

Method of operating metal molding system configured to handle mold, system including injection unit having: output port; and machine nozzle defining conduit passageway, nozzle including: egress end, ingress end, conduit passageway for receiving molten metal; and mechanical valve received in passageway, valve positioned between egress end and ingress end, and valve operable in opened and closed positions. Method includes: processing volume of molten metal; placing valve in closed position, so that prior to application of injection pressure by unit, volume of molten metal is located; (i) downstream of valve, and (ii) between egress end and valve; and placing valve in opened position, so that volume of molten metal is injected, in response to application of injection pressure into, at least in part, mold cavity; and actuating valve to closed position, so that another volume of molten metal is located: (i) downstream of valve, and (ii) between egress end and valve.

7 Claims, 7 Drawing Sheets

METAL MOLDING

CROSS-REFERENCE TO RELATED APPLICATION

This patent application is a continuation of application Ser. No. 11/347,302, filed Feb. 6, 2006, which is a continuation of application Ser. No. 11/297,926, filed Dec. 9, 2005. This patent application also claims the benefit and priority date of prior U.S. patent application Ser. No. 11/347,302, filed Feb. 6, 2006 and U.S. patent application Ser. No. 11/297,926, filed Dec. 9, 2005

TECHNICAL FIELD

The present invention generally relates to, but is not limited to, molding systems, and more specifically the present invention relates to, but is not limited to, a metal molding conduit assembly, a metal molding system, a metal molding process, a metal-molded article and/or a mold.

BACKGROUND

U.S. Pat. No. 5,040,589 (Filed: Feb. 10, 1989; Inventor: Bradley et al; Assignee: The Dow Chemical Company, U.S.A.) discloses forming a plug of solid metal (in a nozzle of an injection molding machine) from a residue of molten metal that remains after a mold cavity is filled. A conduit passageway has a volume of molten metal located upstream of a formed metal plug (that is, a blockage). This arrangement appears to have become an established approach for configuring molten metal conduit passageways, and this approach has not changed since the filing date of this patent (as will be demonstrated in a review of the state of the art below). The formed (solid) plug is injected into a mold, and the plug is caught in a plug catcher so that the plug is thus prevented from entering the mold cavity defined by the mold. The plug becomes a vestige that needs to be removed from the molded article (in which case, the removed plug represents a waste of molding material). For molded articles having a large size, this arrangement may or may not represent a problem. However, for smaller molded articles (such as cell-phone housings, laptop housings, etc), this arrangement may represent a problem.

Published article titled Semi-solid Forming of Aluminum and Magnesium (Publication date: June 1996; Author: A. I. "Ed" Nussbaum; Journal Name: Light Metal ABE) discloses a mold cavity which has a catcher that catches a metallic plug so that the plug, once caught, does not impede the flow of molten metal into the mold cavity.

PCT Patent Application No. WO/9928065A1 (Filed: Nov. 30, 1998; Inventor: Murray et al; Assignee: Commonwealth Scientific and Industrial Research Organisation, Australia) discloses a metal molding system that includes a conduit passageway having a volume of molten metal located upstream of a plug (that is, a blockage). This arrangement appears to conform to the industry-accepted approach for injecting molten metal into a mold cavity.

U.S. Pat. No. 6,533,021 (Filed: Sep. 14, 2000; Inventor: Shibata et al; Assignee: Ju-Oh Inc., Japan, and The Japan Steel Works Ltd., Japan) discloses a metal molding system that includes a conduit passageway having a volume of molten metal located upstream of a plug (that is, a blockage). The plug is blocked from entering a mold cavity and then it becomes partially melted (by a heater) so that molten metal may flow past the plug. Since the plug is blocked from entering the mold cavity, the plug partially resists the flow of molten metal. This arrangement may reduce the quality of the molded part and/or may increase cycle time needed to mold an article. If the plug is melted before injection pressure is applied, the molten metal begins to drool (and a potentially low-quality part may be formed). If the plug is melted after the injection pressure is applied, the plug may become jammed in an entrance leading into a mold cavity and then the plug acts to restrict (at least in part) flow of the molten metal flowing from upstream toward downstream and then into the mold cavity (and potentially increase cycle time). The timing of when to begin heating the plug (relative to when injection pressure is actuated) may be difficult to achieve on a repeatable and reliable basis.

U.S. Pat. No. 6,938,669 (Filed: Aug. 28, 2002; Inventor: Suzuki et al; Assignee: DENSO Corporation, Japan) discloses a metal molding system that includes a conduit passageway having a volume of molten metal located upstream of a plug (that is, a blockage). This arrangement appears to conform to the industry-accepted approach for injecting molten metal into a mold cavity.

PCT Patent Application No. WO/03106075A1 (Filed: May 5, 2003; Inventor: Czerwinski et al; Assignee: Husky Injection Molding Systems Limited, Canada) discloses a metal molding system that includes a conduit passageway having a volume of molten metal located upstream of a plug (that is, a blockage). This arrangement appears to conform to the industry-accepted approach for injecting molten metal into a mold cavity.

U.S. Patent Application No. 2005/0006046A1 (Filed: Aug. 10, 2004; Inventor: Tanaka et al; Assignee: Kabushiki Kaisha Kobe Seiko Sho (Kobe Steel, Ltd), Japan) discloses a metal molding system that includes a conduit passageway having a volume of molten metal located upstream of a plug (that is, a blockage). An injection pressure injects the plug, which is followed by a flow of the volume of molten metal into the mold cavity. The mold cavity has a catcher that catches the injected plug so that it remains offset from the molten metal that flows into the mold cavity (thereby the plug does not resist or impede the flow). This arrangement appears to be an industry-accepted approach that results in a molded article having a (potentially large) vestige that includes the plug embedded therein. A large vestige may cause heat deformation of the molded part if the vestige is formed on a thin wall (of the molded part) because the vestige has a thermal mass which may cool slower than the mass of the thin wall. This arrangement may result in increased manufacturing costs since the large vestige represents a waste of material and/or requires effort to remove it from the molded article, and/or represents a limit as to how thin the molded article can be made.

It appears that the metal molding process as described above (established over a 15 year period without apparent deviation) is to pass, through a passageway conduit, a volume of molten metal that is located upstream of a passageway blockage (that is, upstream in a sense that the shot is located between the plug and an injection unit of the metal molding system), and that the way to manage the plug is to catch it in a plug catcher.

SUMMARY

According to a first aspect of the present invention, there is provided a metal molding conduit assembly 700, including a conduit passageway 702 configured to pass a volume of molten metal 704 located downstream of a mechanical valve 706 that is not operatively connected to an injection unit 708 of a metal molding system 710.

According to a second aspect of the present invention, there is provided a metal molding system 710, including a metal molding conduit assembly 700 including a conduit passageway 702 configured to pass a volume of molten metal 704 located downstream of a mechanical valve 706 that is not operatively connected to an injection unit 708 of a metal molding system 710.

According to a third aspect of the present invention, there is provided a metal molding process, including passing, via a conduit passageway 702, a volume of molten metal 704 located downstream of a mechanical valve 706 that is not operatively connected to an injection unit 708 of a metal molding system 710.

According to a fourth aspect of the present invention, there is provided a molded article having a body made by a metal molding process, including passing, via a conduit passageway 702, a volume of molten metal 704 located downstream of a mechanical valve 706 that is not operatively connected to an injection unit 708 of a metal molding system 710.

According to a fifth aspect of the present invention, there is provided a mold including a body defining a mold cavity configured to connect to a metal molding conduit assembly 700 including a conduit passageway 702 configured to pass a volume of molten metal 704 located downstream of a mechanical valve 706 that is not operatively connected to an injection unit 708 of a metal molding system 710.

A technical effect of the present invention provides a molding arrangement that mitigates the disadvantages associated with the state of the art pertaining to molding, at least in part.

BRIEF DESCRIPTION OF THE DRAWINGS

A better understanding of the exemplary embodiments of the present invention (including alternatives and/or variations thereof) may be obtained with reference to the detailed description of the exemplary embodiments along with the following drawings, in which.

Figure 1:
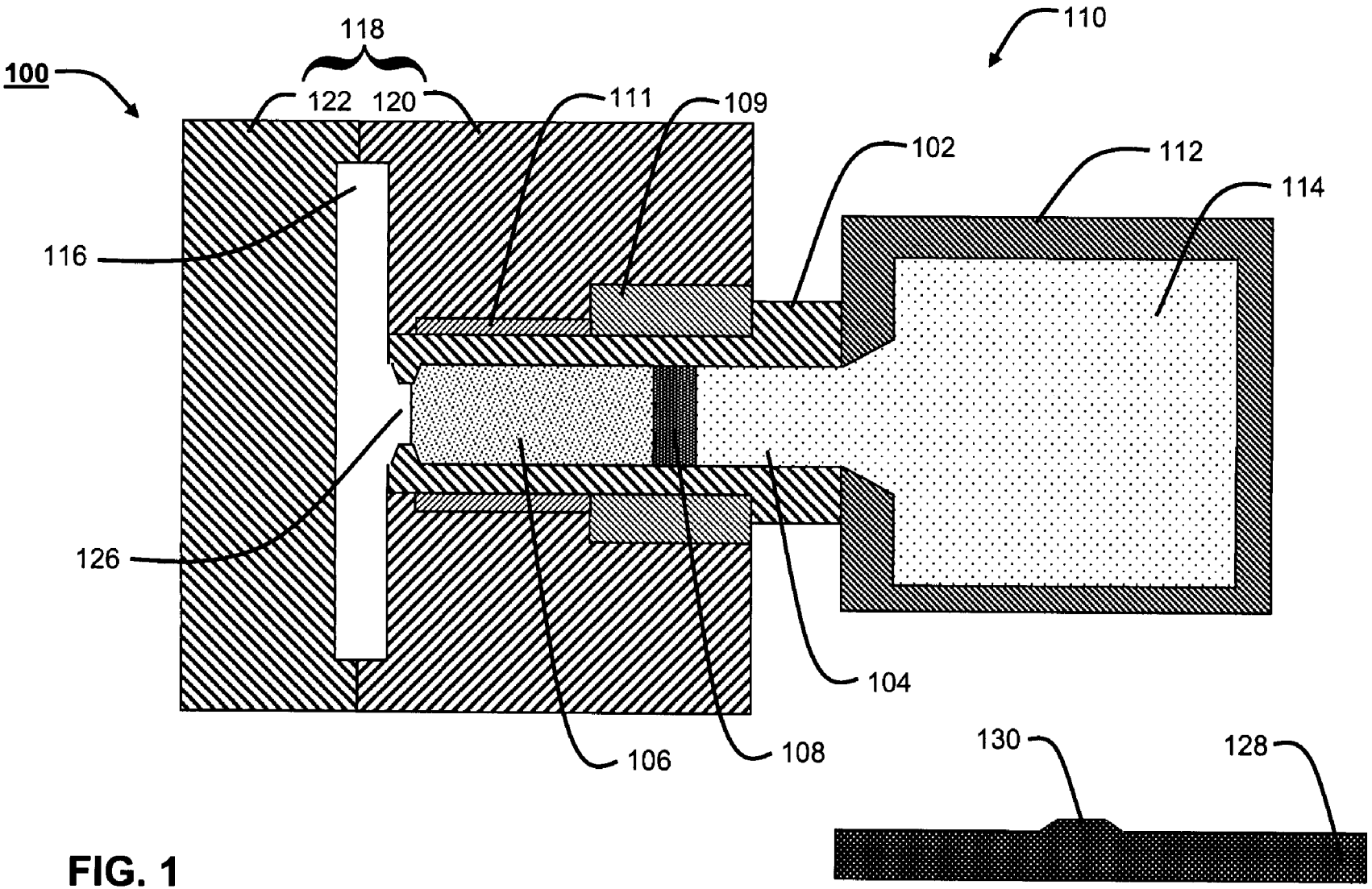
FIG. 1 is a cross-sectional view of a metal molding conduit assembly 100 according to a first embodiment.

The drawings are not necessarily to scale and are sometimes illustrated by phantom lines, diagrammatic representations and fragmentary views. In certain instances, details that are not necessary for an understanding of the embodiments or that render other details difficult to perceive may have been omitted.

REFERENCE NUMERALS USED IN THE DRAWINGS

The following is a listing of the elements designated to each reference numerals used in the drawings.

| | |
|---|---|
| metal molding conduit assembly | 100 |
| conduit body member | 102 |
| conduit passageway | 104 |
| volume of molten metal | 106 |
| blockage | 108 |
| blockage-forming mechanism | 109 |
| metal molding system | 110 |
| heating mechanism | 111 |
| injection unit | 112 |
| molten metal | 114 |
| mold cavity | 116 |
| mold | 118 |
| stationary mold half | 120 |
| movable mold half | 122 |
| egress | 126 |
| molded article | 128 |
| vestige | 130 |
| metal molding conduit assembly | 200 |
| conduit passageway | 202 |
| volume of molten metal | 204 |
| upstream blockage | 206 |
| metal molding system | 208 |
| injection unit | 209 |
| body members | 210A, 210B |
| downstream blockage | 212 |
| plug forming mechanism | 213 |
| mold | 214 |
| stationary mold half | 216 |
| movable mold half | 218 |
| heating mechanism | 220 |
| metal molding conduit assembly | 300 |
| metal molding system | 302 |
| injection unit | 303 |
| conduit passageway | 304 |
| volume of molten metal | 306 |
| passageway blockage | 308 |
| body members | 310A, 310B, 310C |
| sprue | 310A |
| cooling mechanism | 310B |
| machine nozzle | 310C |
| mold | 312 |
| movable mold half | 314 |
| stationary mold half | 316 |
| mold cavity | 318 |
| metal molding conduit assembly | 400 |
| molten metal hot runner assembly | 401 |
| conduit passageway | 402 |
| metal molding system | 403A |
| injection unit | 403B |
| nozzle | 403C |
| volume of molten metal | 404 |
| passageway blockage | 406 |
| conduit body member | 408 |
| drops | 410A, 410B |
| mold cavity | 412 |
| blockages | 416A, 416B, 416C |
| blockage-forming mechanisms | 418A, 418B, 418C |
| volumes | 420A, 420B |
| heating mechanisms | 422A, 422B |
| mold | 424 |
| movable mold half | 426 |
| stationary mold half | 428 |
| plug catcher | 430 |
| molten metal hot spure assembly | 500 |
| conduit passageway | 502 |
| volume of molten metal | 504 |
| passageway blockage | 506 |
| hot sprues | 508A, 508B |
| blockages | 509A, 509B |
| hot runner assembly | 510 |
| molds | 512A, 512B, 512C, 512D |
| machine nozzle | 514 |
| metal molding conduit assembly | 600 |
| conduit passageway | 602 |
| volume of molten metal | 604 |
| passageway blockage | 606 |
| mold cavity | 608 |
| blockage-forming mechanism | 610 |
| metal molding system | 612 |

-continued

| | |
|---|---|
| body member | 614 |
| mold | 616 |
| metal molding conduit assembly | 700 |
| conduit passageway | 702 |
| volume of molten metal | 704 |
| mechanical valve | 706 |
| injection unit | 708 |
| metal molding system | 710 |
| body member | 712 |
| mold | 714 |
| mold cavity | 716 |

DETAILED DESCRIPTION OF THE EXEMPLARY EMBODIMENTS

FIG. 1 is a cross-sectional view of a metal molding conduit assembly 100 according to a first embodiment of the present invention.

The metal molding conduit assembly 100 includes a conduit passageway 104 configured to pass a volume of molten metal 106 (hereafter referred to as the "volume" 106) located downstream of a passageway blockage 108 (hereafter refer to as the "blockage" 108). The blockage 108 is formable in the conduit passageway 104.

The conduit passageway 104 is defined by at least one conduit body member 102 (as depicted in FIG. 1) or may be defined by a plurality of conduit body members (described in embodiments below). The conduit body member 120 is hereafter called the "body member" 102. According to the first embodiment, the body member 102 is a machine nozzle that defines the conduit passageway 104 and it is attached to an injection unit 112. The injection unit 112 is depicted schematically. The conduit passageway 104 connects the injection unit 112 to a mold 118. It is to be understood that "upstream" is toward the injection unit 112 and "downstream" is toward the mold 118.

The blockage 108 is located upstream relative to the volume of molten metal 106. The metal molding conduit assembly 100 is used in a metal molding system 110 (not entirely depicted in FIG. 1). The volume of molten metal 106 is, preferably, proximate or adjacent to the blockage 108. The blockage 108 is formable by a blockage-forming mechanism 109 configured to cooperate with the conduit passageway 104. The volume of molten metal 106 is also called a downstream volume of molten metal 106, and the blockage 108 is also called an upstream blockage 108

The metal molding system 110 includes the injection unit 112 that processes a molten metal 114. The molten metal 114 is introduced into the injection unit 112 by a hopper assembly (not depicted) that is attached to the injection unit 112. The molten metal 114 exists in a slurry state that includes a liquefied-metallic component and a solidified-metallic component, or includes only the liquefied-metallic component (in some instances). Preferably, the molten metal 114 is a thixotropic metal having an alloy of magnesium. Other metallic alloys are contemplated, such as zinc and/or aluminum, etc) in a liquid state or a slurry state (a slurry state includes the metal in liquid form having solid particles of the metal carried therein).

The upstream blockage 108, preferably, is a plug 108 that is formable in the conduit passageway 104 by the blockage-forming mechanism 109. The plug 108 may be a thixo plug (for example), which is formed from a slurry of an alloy of magnesium or other metal. The plug 108 is solidified within the conduit passageway 104 and friction between the inner wall of the conduit 104 and the outer surface of the plug 108 frictionally cooperate to retain the plug 108 to the inner wall of the conduit 104. Sometimes the term "welded" is used to describe that the plug 108 is frictionally engaged to the passageway conduit 104.

The blockage-forming mechanism 109 provides localized cooling sufficient enough to form the blockage 108 in the passageway 104. Preferably the blockage-forming mechanism 109 is a cooling mechanism that actively removes heat to form the plug 108. Alternatively, the blockage-forming mechanism 109 is a heating mechanism 111 that forms the plug 108 by shutting off or reducing generated heat supplied to molten metal contained in the conduit passageway 104 (so that the molten metal may cool off when heat is not supplied thereto). The blockage-forming mechanism 109 may be distributed and available along a length of the passageway 104 to permit forming blockages at different locations along the passageway 104 to provide differently-sized volumes (of molten metal) for different molded parts (assuming the desire to reuse the same conduit for different parts).

The body member 102 has one end connected to the injection unit 112, and has another end that leads into a mold cavity 116 of the mold 118. The mold cavity 116 is located downstream of the injection unit 112. The mold 116 includes a stationary mold half 120 and a movable mold half 120. The injection unit 112 is a source of molten metal, and the mold cavity 116 is the receiver of the volume of molten metal 106.

In operation, before the volume 106 is injected into the mold cavity 116, the heating mechanism 111 actively maintains the volume 106 in a substantially non-drooling state so that the volume 106 does not substantially drool into the mold cavity 116 before an injection pressure is imposed by the injection unit 112 onto the volume 106. Before the volume 106 is injected, the volume 106 facing the entrance of the mold cavity is exposed to air, oxidizes and may solidify upon exposure to open air contained in the mold cavity 116. However, the volume 106 does not necessarily solidify at the entrance of the mold cavity 116 if enough heat is applied to the volume 106. Responsive to application of the injection pressure, a stream of molten metal is made to flow downstream through the conduit passageway 104. The injected molten metal 114 pushes against the blockage 108 with sufficient force so that the blockage 108 gives way and becomes moved downstream along the passageway 104. The moving blockage 108 along with the moving molten metal 114 pushes the volume 106 downstream the passageway 104 and into the mold cavity 116. For a thin-walled (molded) article (which is defined by a thin mold cavity), the blockage 108 is not injected into the mold cavity 116 and it is stopped from moving and remains proximate to a downstream egress 126 of the passageway 104. For a thick-walled (molded) article (which is defined by a thick mold cavity), the blockage 108 may be injected into the mold cavity. The volume 106 is large enough to fill in the mold cavity 114. Once a molded article 128 is cooled sufficiently, the mold halves 120, 122 are actuated to separate from each other so that the molded article 128 may be extracted from the mold cavity 116. Before another volume is injected into the mold cavity 116, the blockage 108 located at the downstream egress 126 is melted by the heating mechanism 111 while another blockage is formed upstream of the next volume to be injected.

A technical effect of the first embodiment is that this arrangement permits the molded article 128 to have, advantageously, fewer defects (since the flow of the volume was not resisted by the blockage 108) and/or less wasted material (since there is no plug catcher that requires removal from the molded article 128). The molded article 128 is made with less molten metal which reduces material costs and/or material scrap. This molding arrangement provides improving quality and/or reduced cost of molding.

The blockage 108, when embodied as the upstream plug, is maintained fictionally engaged to the conduit passageway 104 sufficiently enough to resist a molten-metal residual pressure originating from the injection unit 112, but the blockage 108 gives way responsive to the injection pressure (that is generated by the injection unit 112). The blockage 108 is formable at a predetermined position along the conduit passageway 104 to change the size of the volume of molten metal 106. The blockage 108 is configured to release from the conduit passageway 104 responsive to the injection pressure bearing on the blockage 108, travel downstream along the passageway 104 and become jammed into an egress 126 of the passageway 104. The jammed blockage 108 bears a pressure spike that originates from the injection unit 112 sufficiently enough to substantially prevent the pressure spike from entering the mold cavity 116 and causing the volume of molten metal 106 to flash from the mold cavity 116 (once the volume 106 has entered the mold cavity 116). After injection of the volume (at least in part), the jammed blockage 108 may be heated into a slurry state or a molten state for the next injection cycle.

The molded article 128 includes a body having a vestige 130 that conforms to the shape of the egress 126 (at least in part). The body has a show side and a non-show side. The vestige 130 is molded on any one of the show side or the non-show side. The vestige 130 may remain with the body or may be removed from the body. Preferably, the vestige 130 is surrounded at least in part by a line of weakness so that the vestige may be removed easily from the body. The molded article 128 is (for example) a thin walled product such as a cover of a laptop computer or a cover of a cell phone. The vestige 130 is formed or positioned in a central zone of the body of the molded article 128. Advantageously, this process may permit a smaller vestige to be formed on the molded part, and if the molded article has a thin wall on which the vestige is formed, the thermal mass of the vestige may cool at the same (near same) rate of that of the thin wall (thus deformation of the thin wall may be avoided).

The stationary mold half 120 of the mold 118 defines a gate entry that leads into a mold cavity that has an 18 mm (millimeters) wide diameter. The movable mold half 122 cooperates with the stationary mold half 120 to define the mold cavity 116 that is about 0.65 mm thick. Preferably, the mold 118 does not form a plug catcher for catching the blockage 108. The gate entry is positioned in a central zone of the stationary mold half 120.

The conduit passageway 104 is configured to connect to a metal-molding system, such as (for example, but not limited to) a die casting system, a thixo-molding system (for molding slurry of metal), or a metal injection molding system.

In an alternative embodiment, the body member 102 includes a barrel of the injection unit 112, and the blockage 108 is formable in an area leading out from the barrel.

In an alternative embodiment, the volume of molten metal 106 is a metallic shot having a volume equal to a volume of a mold cavity 116.

Figure 2:
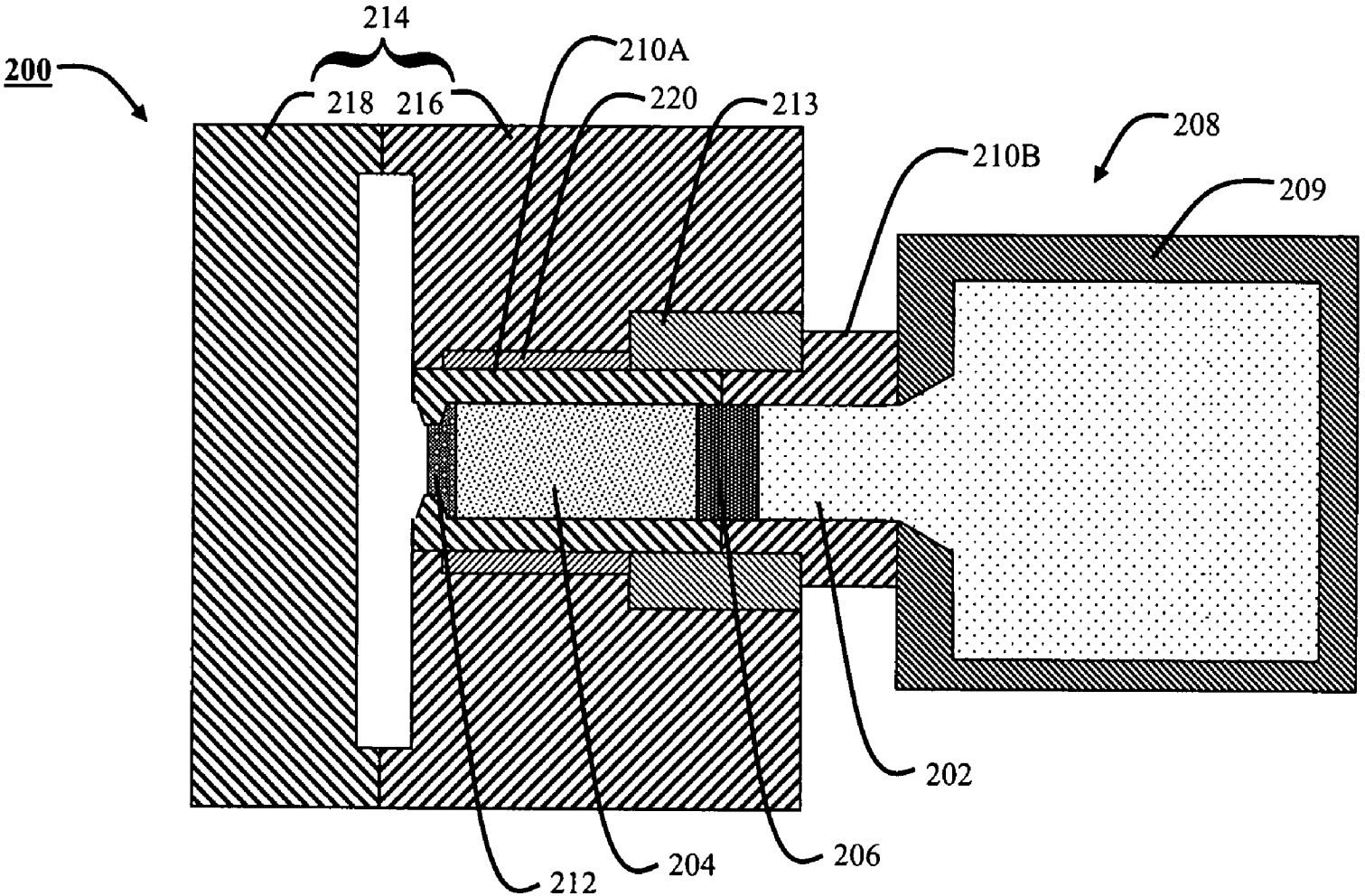
FIG. 2 is a cross-sectional view of a metal molding conduit assembly 200 according to a second embodiment.

FIG. 2 is a cross-sectional view of a metal molding conduit assembly 200 according to a second embodiment of the present invention.

The metal molding conduit assembly 200 includes a conduit passageway 202 configured to pass a volume of molten metal 204 (hereafter referred to as the "volume" 204) located downstream of a passageway blockage 206 (hereafter referred to as the "blockage" 206). The blockage 206 can be called an upstream blockage 206. The blockage 206 is formable in the conduit passageway 202.

The metal molding conduit assembly 200 is included in a metal molding system 208 (partially depicted) having an injection unit 209. The conduit passageway 202 is defined by body members 210A, 210B that cooperate with each other, and the conduit passageway 202 extends therebetween. The body member 210A is a hot sprue, and the member 210B is a machine nozzle that is connected to the injection unit 209. The conduit passageway 202 is also configured to have a downstream blockage 212 formable therein, and the downstream blockage 212 is located downstream of the upstream blockage 206. The volume of molten metal 204 is located between the downstream blockage 212 and the upstream blockage 206.

The downstream blockage 212 includes a downstream plug 212 (plug 212 may be a thixo plug), and the upstream blockage 206 includes an upstream plug 206 (plug 206 may be a thixo plug) both of which are formable in the passageway 202. The plug 212 is formed by a plug forming mechanism 213. The blockage 212, when frictionally engaged to the passageway 202, prevents the next volume from drooling out from the passageway 202 prior to injecting the volume into a mold cavity of the mold 216. The blockage 212 may be a "soft" blockage in that it does not have to be hard frozen. The blockage 212 is maintained soft enough so that the injection pressure can easily dislodge and push the blockage 212 away from the passageway 202 and into the mold cavity. The blockage 212 is maintained soft enough to not provide significant resistance upon being forced (or extruded) to enter a mold cavity defined by a mold 214. The blockage 212 is maintained soft enough to be easily extruded through an entrance of the mold cavity responsive to the blockage 212 experiencing an injection pressure.

A "thin skinned" plug (that is, the downstream blockage 212) is formed at the end of the passageway 202 that leads into a mold after ejection of the molded part from the mold 214. When the mold 214 is opened and the molded part removed therefrom, a thin skin of solidified metal may form and remain at the end of the passageway 202 and this would assist in the prevention of drool (of the next volume) while the thin skinned solidified plug remains (or is maintained) soft enough to be easily pushed into the mold cavity 214 without much resistance. In a sense, the downstream plug is easily extruded into the mold 214 because it remains in a soft-formed condition.

Preferably, the upstream blockage 206 is maintained hard enough to resist becoming extruded through the egress of the conduit (or the entrance of the mold cavity) responsive to the blockage 206 experiencing the injection pressure. In an alternative, the (upstream) blockage 206 is maintained soft enough to be extruded, at least in part, through an entrance of the mold cavity responsive to the blockage 206 experiencing the injection pressure.

The mold 214 includes a stationary mold half 216 and a movable mold half 218. The blockage 212 is formable proximate to an egress end of the conduit passageway 202, and the egress end is positioned at an entrance of the mold cavity. A heating mechanism 220 maintains the volume of molten metal 204 in a non-solidified state. Preferably, the blockage 212 is a soft-formed plug.

A technical effect of the second embodiment is similar to that of the technical effect of the first embodiment.

Figure 3:
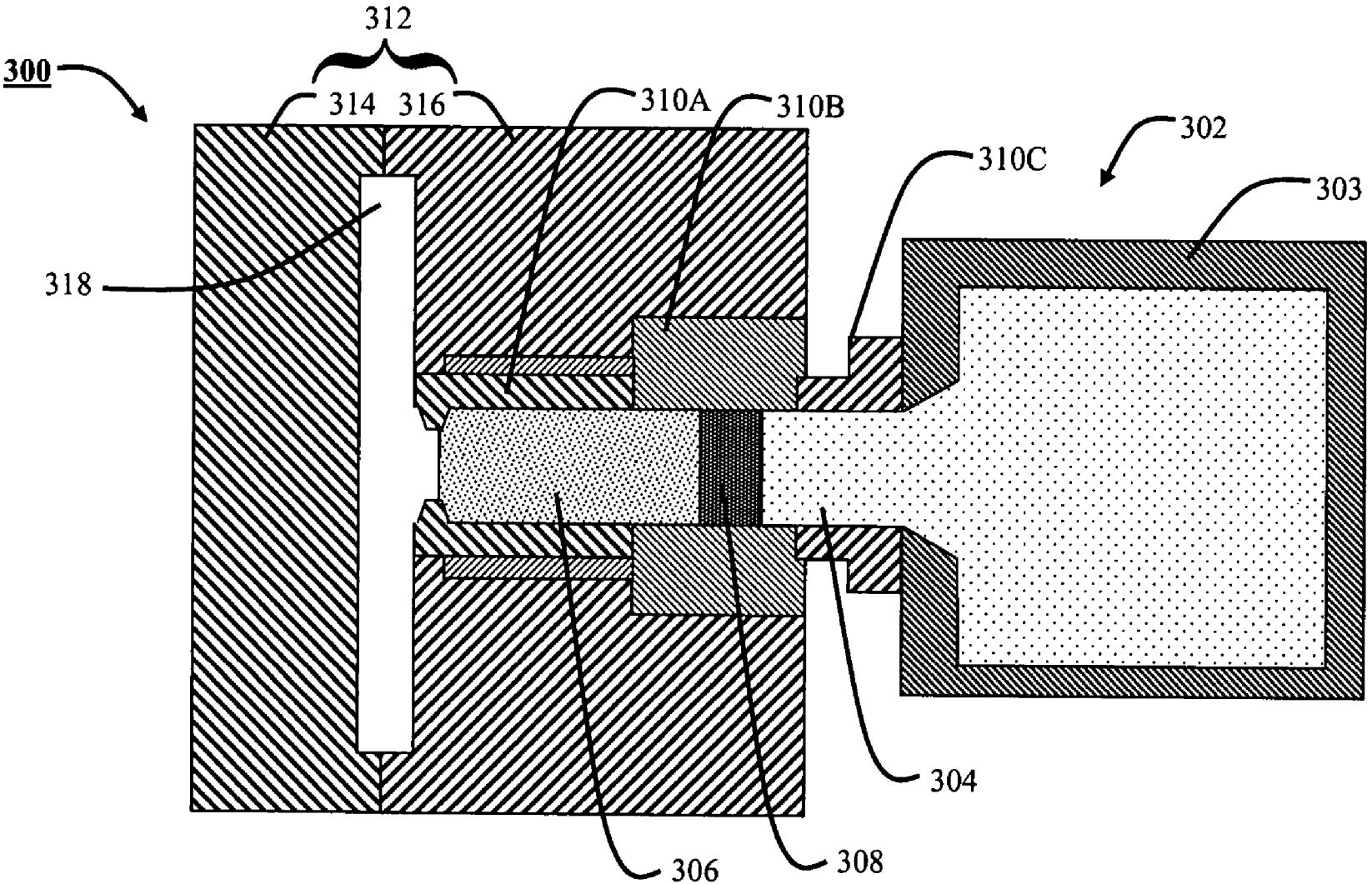
FIG. 3 is a cross-sectional view of a metal molding conduit assembly 300 according to a third embodiment.

FIG. 3 is a cross-sectional view of a metal molding conduit assembly 300 according to a third embodiment of the present invention.

The metal molding conduit assembly 300 is usable in a metal molding system 302 (partially depicted) that has an injection unit 303. The assembly 300 includes a conduit passageway 304 configured to pass a volume of molten metal 306 located downstream of a passageway blockage 308. The passageway blockage 308 is formable in the conduit passageway 304.

The passageway 304 is defined by a plurality of body members 310A, 310B and 310C, such as a hot sprue 310A, a cooling mechanism 310B and a machine nozzle 310C. The cooling mechanism 310B provides a cooling effect, a heat sinking effect, and/or a reduced heating effect. A mold 312 includes a movable mold half 314 and a stationary mold half 316 that define a mold cavity 318. The mold 312 includes a mold body that has a hot half and a cold half. The mold body includes a runner that connects the mold cavity 318 to an entrance of the mold body.

A technical effect of the third embodiment is similar to that of the first embodiment, at least in part.

Figure 4:
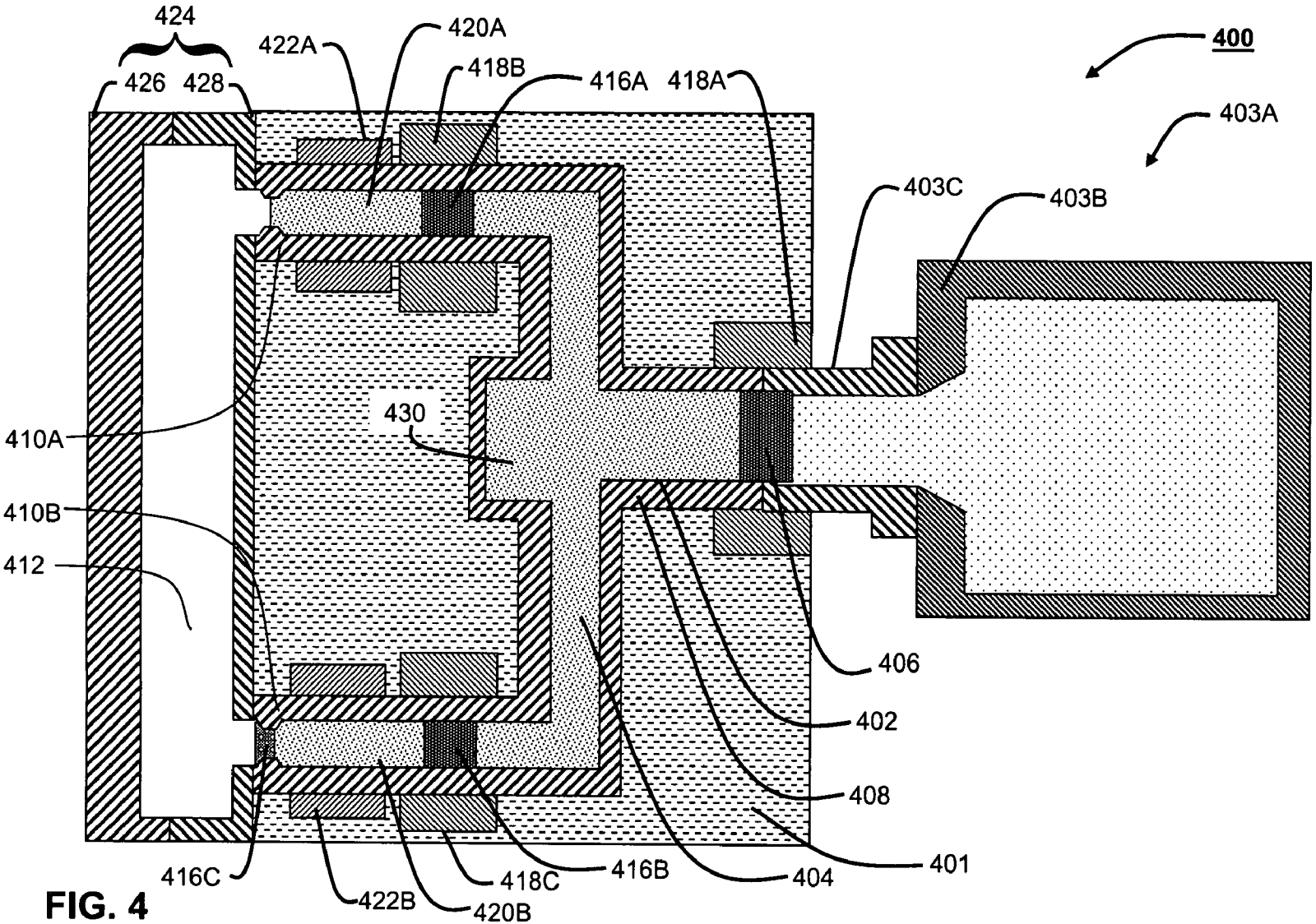
FIG. 4 is a cross-sectional view of a metal molding conduit assembly 400 according to a fourth embodiment.

FIG. 4 is a cross-sectional view of a metal molding conduit assembly 400 according to a fourth embodiment of the present invention.

The assembly 400 is part of a molten metal hot runner assembly 401 that is connectable to a metal molding system 403A having an injection unit 403B. A nozzle 403C connects the injection unit 403B to the hot runner assembly 401. The assembly 400 includes a conduit passageway 402 that passes a volume of molten metal 404 (hereafter referred to as the "volume" 404) located downstream of a passageway blockage 406. The passageway blockage 406 is formable in the conduit passageway 402.

Blockage 406 is used to substantially resist a molten-metal residual pressure that originates from injection unit 403B, and that the downstream blockages 416A, 416B, and/or 416C may be kept (or maintained) in a soft condition and thus not have to resist the molten metal residual pressure but may resist drool pressure that originates from molten metal located between the plugs.

The conduit passageway 402 is defined by a conduit body member 408 that forms a plurality of drops 410A, 410B that lead to a mold cavity 412 defined by a mold 424. The blockage 406, once released from its depicted position, does not interfere with the flow of molten metal since it flows along with the molten metal and melts therein before it hits a bend in the passageway 402. Alternatively, the hot runner assembly may include a plug catcher 430 for catching the plug so that the plug does not disrupt flow of molten metal in to the branches of the hot runner assembly (and plug caught in the catcher 430 is liquefied by applied heating).

The conduit passageway 402 has a plurality of blockages 416A, 416B, 416C that are formable therein. The blockages 406, 416A, 416B are formed by blockage-forming mechanisms 418A, 418B and 418C respectively. The blockage 416C is a "soft" blockage of the type described above in a previous embodiment. The volume 404 is disposed between blockages 406, 416A, 416B. A shot 420A is disposed in the drop 410A. A shot 420B is disposed in the drop 410B. Heating mechanisms 422A and 422B heat the volumes 420A, 420B respectively. A mold 424 includes a movable mold half 426 and a stationary mold half 428.

The blockage 406 is pushed into the passageway 402 but the blockage 406 is melted (by heating mechanisms that are not depicted) before it travels further downstream into any particular branch (either upper or lower branches) of the passageway 402.

A technical effect of the fourth embodiment is similar to that of the first embodiment, at least in part.

Figure 5:
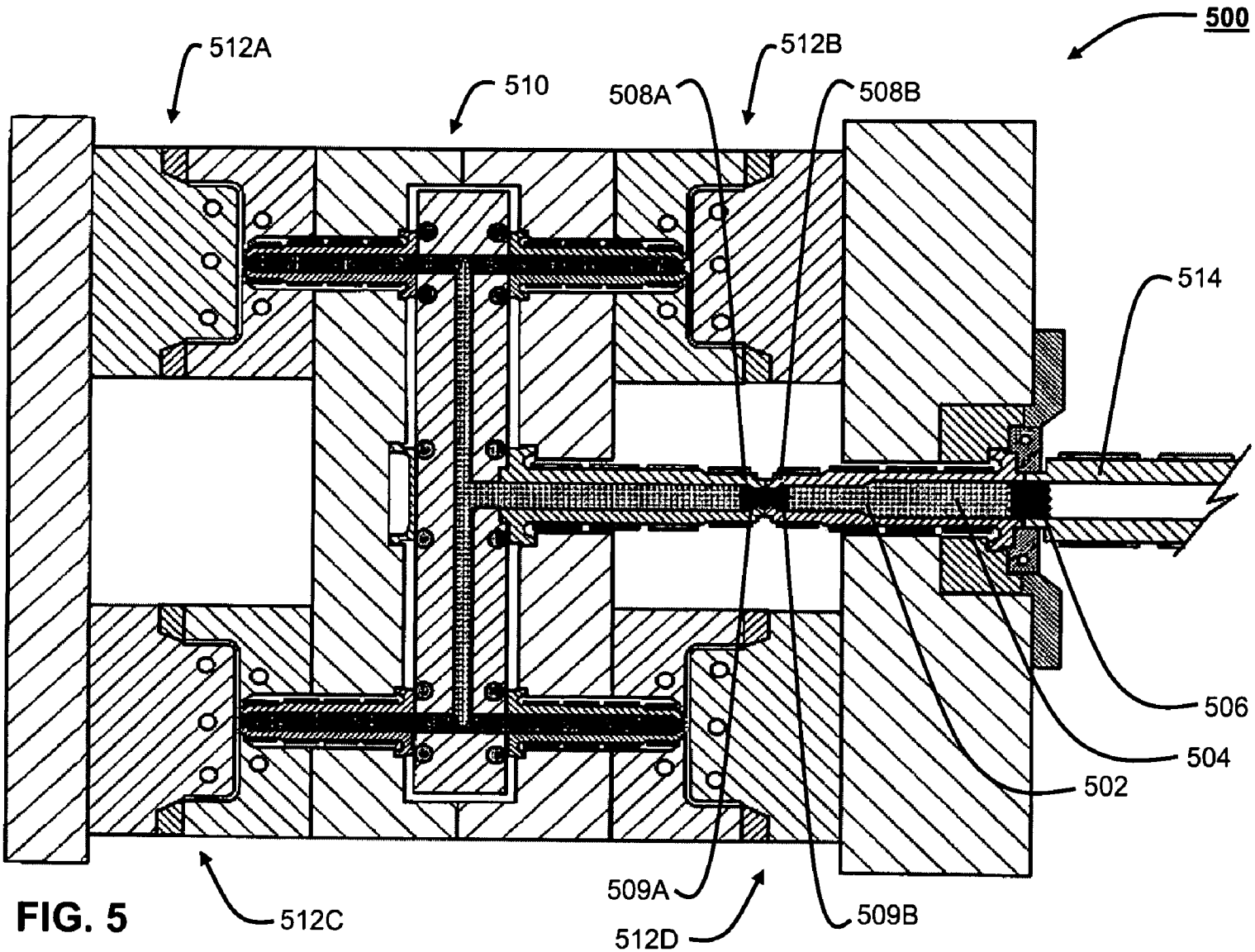
FIG. 5 is a cross-sectional view of a metal molding conduit assembly 500 according to a fifth embodiment.

FIG. 5 is a cross-sectional view of a metal molding conduit assembly 500 according to a fifth embodiment of the present invention.

The metal molding conduit assembly 500 includes a conduit passageway 502 configured to pass a volume of molten metal 504 located downstream of a passageway blockage 506. The passageway blockage 506 is formable in the conduit passageway 502.

The conduit passageway is 502 is defined by opposed hot sprues 508A, 508B which are part of a hot sprue assembly, otherwise called a stack mold assembly. The passageway 502 is defined by hot sprues 508A, 508B. A hot runner assembly 510 connects one of the hot sprues (508A) to the molds 512A, 512B, 512C, and 512D via branches of a hot runner assembly. The sprues 508A, 508B are separable from each other when molds 512A, 512B, 512C, and 512D are opened.

Blockages 509A, 509B in the sprues 508A, 508B are maintained soft enough to separate from each other and continue remaining within each of their sprues 508A, 508B once they have been separated from each other. A machine nozzle 514 is connected from a metal molding system to the hot sprue 508B.

A technical effect of the fifth embodiment is similar to that of the first embodiment at least in part.

Figure 6:
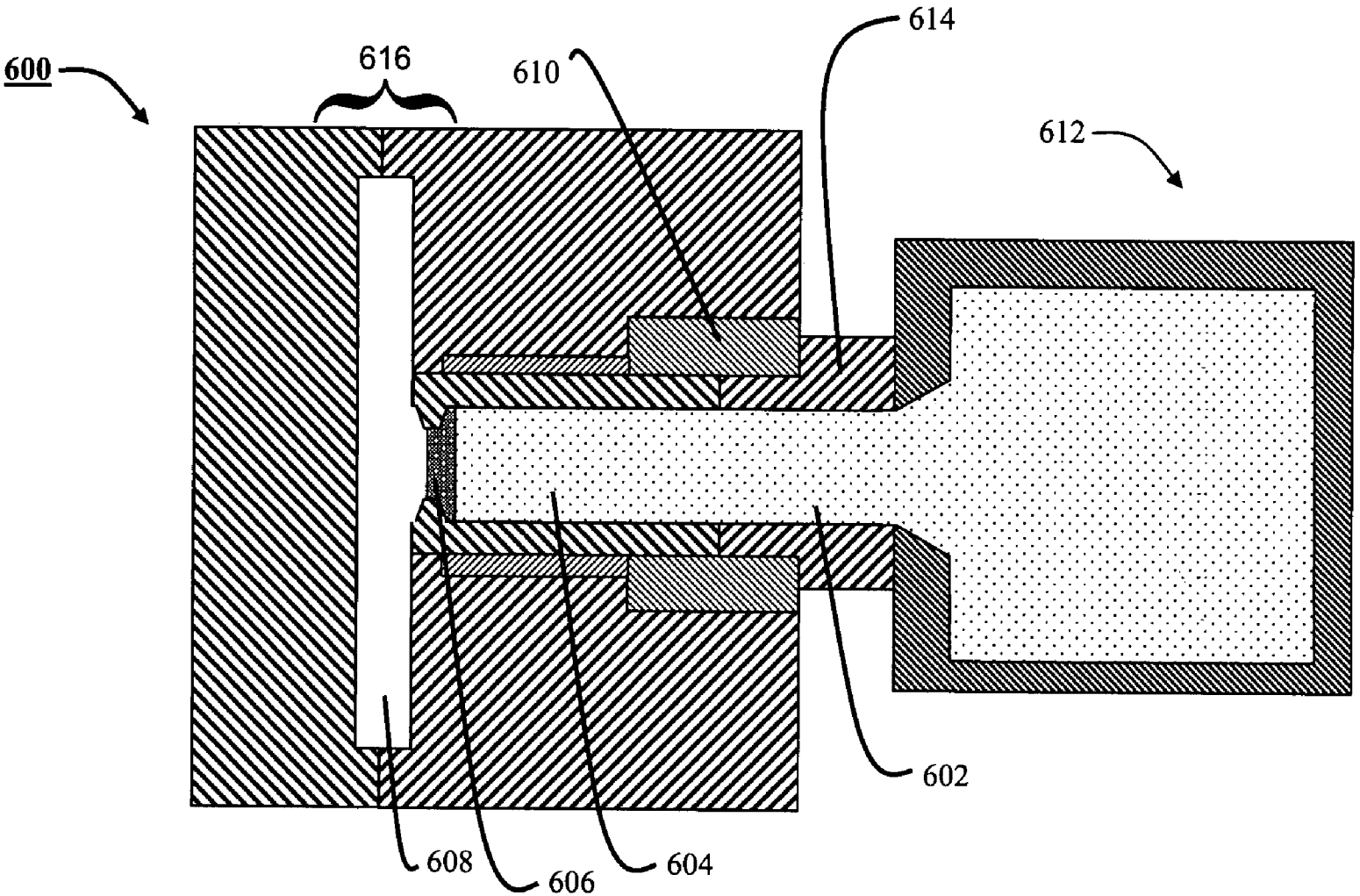
FIG. 6 is a metal molding conduit assembly 600 according to a sixth embodiment of the present invention.

FIG. 6 is a metal molding conduit assembly 600 according to a sixth embodiment of the present invention.

The metal molding conduit assembly 600 includes a conduit passageway 602 configured to pass a volume of molten metal 604 located upstream of a passageway blockage 606 that is formable in the conduit passageway 602. The passageway blockage 606 is maintained to engage the conduit passageway 602 sufficiently enough to prevent the volume of molten metal 604 from drooling out from the conduit passageway 602 prior to the passageway blockage 606 experiencing an injection pressure (applied by a metal molding system 612 by an in injection mechanism or by gravity, etc). The passageway blockage 606 is maintained to remain (or is maintained) soft enough to be pushed past through an entrance of a mold cavity 608 in response to the passageway blockage 606 experiencing an injection pressure that becomes applied to the blockage 606.

The passageway blockage 606 is maintained soft enough so that an injection pressure is sufficient enough to dislodge and push the passageway blockage 606 away from the conduit passageway and into the mold cavity 608 of a mold 616. The passageway blockage 606 is formable by a blockage-forming mechanism 610 that is configured to cooperate with the conduit passageway 602. The passageway blockage 606 includes, preferably, a plug that is formable in the conduit passageway 602 by the blockage-forming mechanism 610. The blockage 606 may also be a thixo plug (as used in conjunction with thixo molding systems).

At least one body member 614 defines the conduit passageway 602. The body member 614 is or includes, preferably, a machine nozzle that is attachable to the metal molding system 612. Alternatively, the conduit passageway 602 is defined by a plurality of body members.

The volume of molten metal 604 is injected into the mold 616 (at least in part). The mold 616 is, preferably, passageway-blockage receiverless (that is, the mold 616 does not have a blockage catcher for receiving a blockage therein). The volume of molten metal 604 is (for example) a metallic shot having a volume equal to a volume of a mold cavity 608.

The conduit passageway 602 is configured to connect to the metal-molding system 612 (examples of which are, but not limited to, a thixo-molding system, a die casting system, and/or a metal injection molding system, etc).

A technical effect of the sixth embodiment is similar to that of the first embodiment, at least in part.

Figure 7:
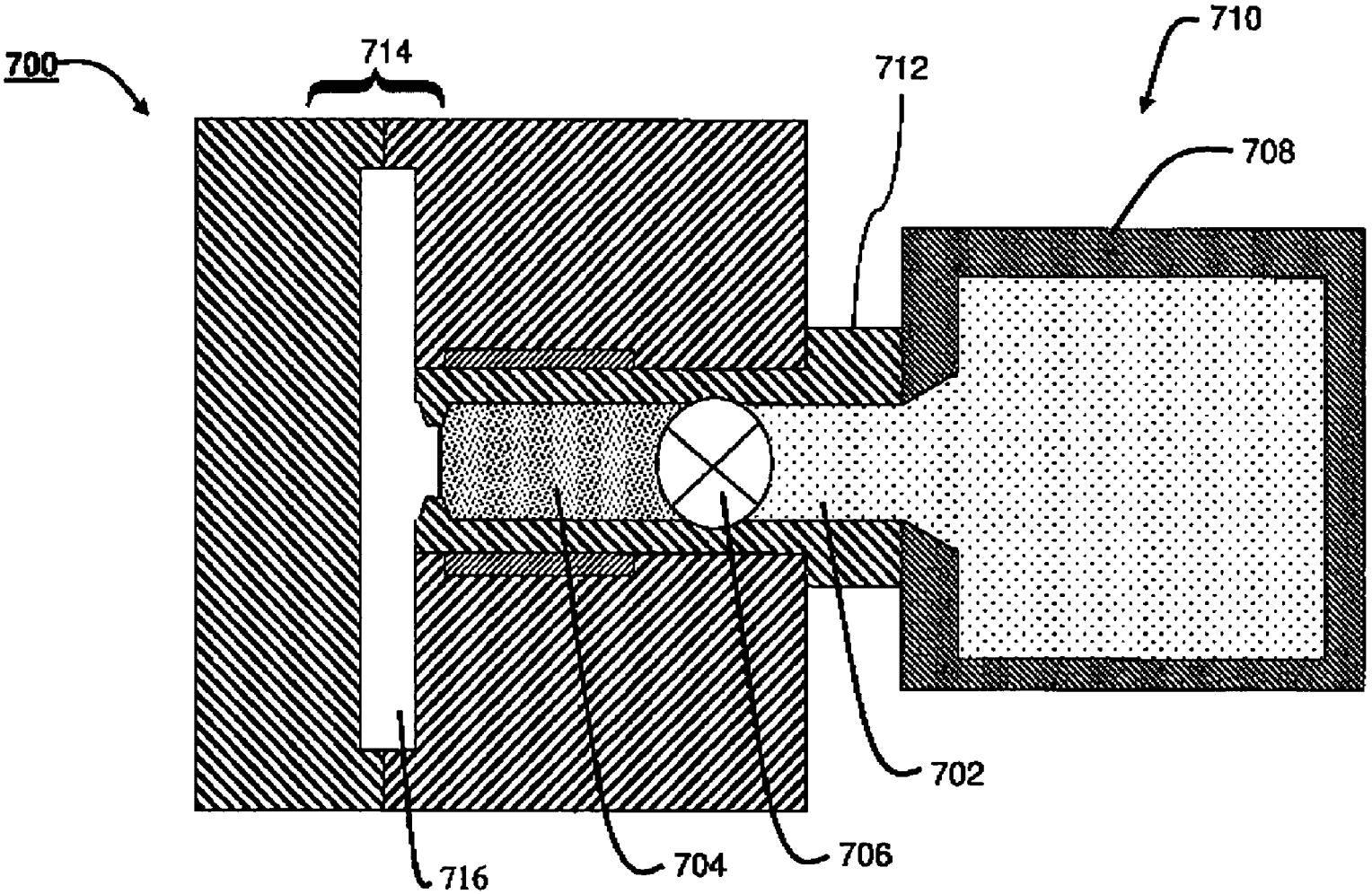
FIG. 7 is a cross-sectional view of a metal molding conduit assembly 700 according to a seventh embodiment of the present invention.

FIG. 7 is a cross-sectional view of a metal molding conduit assembly 700 according to a seventh embodiment of the present invention.

The metal molding conduit assembly 700 includes a conduit passageway 702 configured to pass a volume of molten metal 704 located downstream of a mechanical valve 706 that is not operatively connected to an injection unit 708 of a metal molding system 710.

At least one body member 712 defines the conduit passageway 702. The body member 712, preferably, is or includes a machine nozzle that is attachable to the metal molding system 710. Alternatively, the conduit passageway 702 is defined by a plurality of body members.

In operation, the metal molding system 710 is actuated to apply an injection pressure (by an injection mechanism or by gravity, etc), and then the mechanical valve 706 is actuated to open. In response to the application of the injection pressure, the volume of molten metal 704 is injected into a mold cavity 716 of a mold 714 (at least in part), and then the valve 706 is actuated to close. The mold 714 is, preferably, passageway-blockage receiverless (that is, the mold 714 does not have a blockage catcher for receiving a blockage therein regardless of whether or not a blockage or a plug was or was not formed in the passageway 702). The volume of molten metal 704 is (for example) a metallic shot having a volume equal to a volume of the mold cavity 716.

The conduit passageway 702 is configured to connect to the metal-molding system 710 (examples of which are, but not limited to, a thixo-molding system, a die casting system, and/or a metal injection molding system).

A technical effect of the seventh embodiment is similar to that of the first embodiment, at least in part.

The description of the exemplary embodiments provides examples of the present invention, and these examples do not limit the scope of the present invention. It is understood that the scope of the present invention is limited by the claims. The concepts described above may be adapted for specific conditions and/or functions, and may be further extended to a variety of other applications that are within the scope of the present invention. Having thus described the exemplary embodiments, it will be apparent that modifications and enhancements are possible without departing from the concepts as described. Therefore, what is to be protected by way of letters patent are limited only by the scope of the following claims:

What is claimed is:

1. A metal molding system (403A), comprising:

a mold cavity (412);

a metal hot runner assembly (401) for supplying molten metal to the mold cavity (412); and a metal injection unit (403B) connected to the metal hot runner assembly (401) via a nozzle (403C) for supplying molten metal to the metal hot runner assembly (401);

wherein the metal hot runner assembly (401) comprises:

a metal molding conduit assembly (400) with a conduit passageway (402), wherein the conduit passageway (402) is defined by a conduit body member (408) that forms a central passageway configured to receive molten metal from the metal injection unit (403B) and a plurality of drops (410A, 410B) leading to the mold cavity (412);

means (418A) for forming a metal plug (406) in the central passageway configured to receive molten metal from the metal injection unit (403B); and a plug catcher (430) disposed at an end of the central passageway and configured to catch the metal plug (406) so that the metal plug (406) does not disrupt flow of molten metal into the plurality of drops (410A, 410B) leading to the mold cavity (412).

2. The metal molding system (403A) of claim 1, wherein:

the mold cavity (412) is defined by a mold (424) including a movable mold half (426) and a stationary mold half (428).

3. The metal molding system (403A) of claim 1, further comprising:

means for liquefying the metal plug (406) caught in the plug catcher (430) by applied heating.

4. The metal molding system (403A) of claim 1, further comprising:

means (418B, 418C) for forming respective metal plugs (416A, 416B, 416C) in the plurality of drops (410A, 410B) leading to the mold cavity (412).

5. The metal molding system (403A) of claim 4, further comprising:

heating means (422A, 422B) for heating metal volumes (420A, 420B) downstream of the means (418B, 418C) for forming respective metal plugs (416A, 416B, 416C) in the plurality of drops (410A, 410B) leading to the mold cavity (412).

6. The metal molding system (403A) of claim 4, wherein:

the plurality of drops (410A, 410B) leading to the mold cavity (412) comprise respective egresses downstream of the means (418B, 418C) for forming respective metal plugs (416A, 416B, 416C) configured to stop the respective metal plugs (416A, 416B, 416C) from moving into the mold cavity (412).

7. The metal molding system (403A) according to any one of claims 1 to 6, wherein:

the means (418A) for forming a metal plug (406) are cooling means or heating means.

* * * * *